US008453307B2

(12) United States Patent
Fishkin et al.

(10) Patent No.: US 8,453,307 B2
(45) **Date of Patent: *Jun. 4, 2013**

(54) ALIGNMENT ASSEMBLY FOR USE WITH A PRINTHEAD

(75) Inventors: Mikhail Fishkin, Rochester, NY (US); Michael S. Hanchak, Dayton, OH (US); Charles D. Rike, Lebanon, OH (US); Allan M. Waugh, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 398 days.

This patent is subject to a terminal disclaimer.

(21) Appl. No.: 12/821,228

(22) Filed: Jun. 23, 2010

(65) Prior Publication Data

US 2011/0314650 A1 Dec. 29, 2011

(51) Int. Cl.
*B25B 27/14* (2006.01)

(52) U.S. Cl.
USPC ..... 29/281.1; 29/281.5; 269/291

(58) Field of Classification Search
USPC . 29/281.1, 281.5; 269/902, 291, 297; 347/50, 347/77, 75
See application file for complete search history.

(56) References Cited

U.S. PATENT DOCUMENTS

| | | | | |
|---|---|---|---|---|
| 4,080,607 | A * | 3/1978 | Van Breemen et al. | 347/74 |
| 5,782,445 | A * | 7/1998 | Cleek | 248/206.5 |
| 7,370,943 | B2 * | 5/2008 | Imai et al. | 347/58 |
| 7,517,065 | B2 * | 4/2009 | Isono | 347/71 |
| 7,819,501 | B2 * | 10/2010 | Hanchak et al. | 347/49 |

* cited by examiner

*Primary Examiner* — Jeanette E Chapman
*Assistant Examiner* — Daniel Kenny
(74) *Attorney, Agent, or Firm* — William R. Zimmerli

(57) ABSTRACT

An alignment component includes first and second members and locating elements. The first member includes at least one surface. The second member includes first and second through holes positioned relative to each other. The second member is affixed with the first member such that first and second pockets are formed. The first and second pockets have a wall corresponding to a wall of the first or second through holes. The first and second pockets have a base corresponding to a surface of the one or more surfaces of the first member. The locating elements include first and second locating elements positioned with an interference fit in the first and second pockets. A wall and a base of the first and second pockets define first and second components of position, respectively, of the first locating element relative to the second locating element.

19 Claims, 7 Drawing Sheets

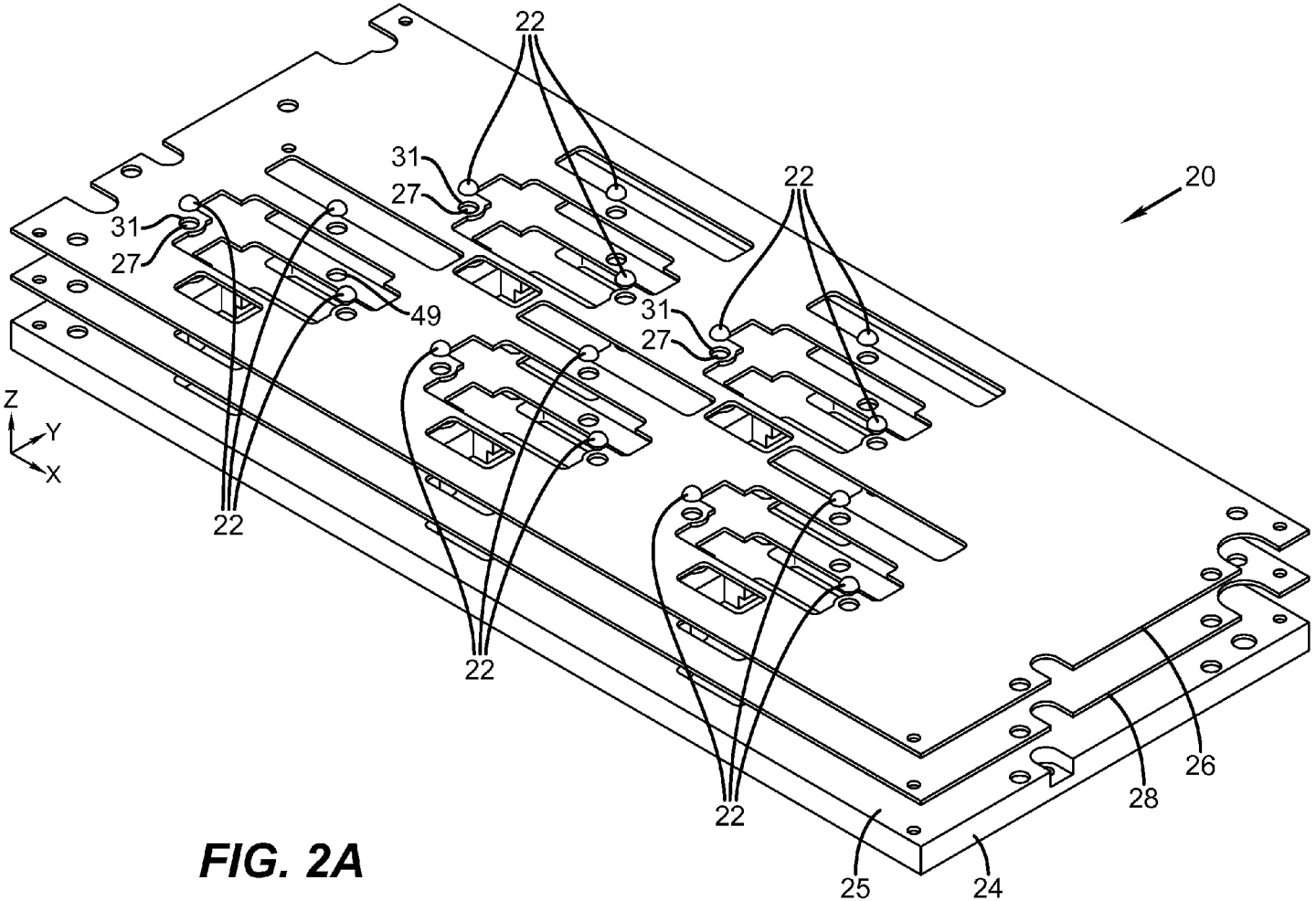
20
22
22
22

ALIGNMENT ASSEMBLY FOR USE WITH A PRINTHEAD

CROSS REFERENCE TO RELATED APPLICATIONS

Reference is made to commonly-assigned, U.S. Patent Publication No. 2009/0295878 published Dec. 2, 2009, Hanchak et al. and U.S. patent application Ser. No. 12/821,220, entitled "PRINTHEAD INCLUDING ALIGNMENT ASSEMBLY" filed currently herewith.

FIELD OF THE INVENTION

The present invention relates to component alignment, and more particularly, to aligning various components of an inkjet printhead such as, for example, a continuous inkjet printhead.

BACKGROUND OF THE INVENTION

The use of inkjet printers for printing information on recording medium is well established. Printers employed for this purpose include continuous inkjet systems which emit a continuous stream of drops from which specific drops are selected for printing in accordance with print data. Other printers include drop-on-demand inkjet systems that selectively form and emit printing drops only when specifically required by print data information. In some drop-on-demand inkjet systems, a printhead including a piezoelectric element is used to generate a pressure wave that expels drops in an on-demand fashion. In some drop-on-demand inkjet systems, drops are expelled from a printhead by the fast growth of a vapor bubble.

Continuous inkjet systems typically include a printhead that incorporates a liquid supply system and a nozzle plate having a plurality of nozzles fed by the liquid supply system. The liquid supply system provides a continuous flow of the liquid to the nozzles with a pressure sufficient to jet an individual stream of the liquid from each of the nozzles.

In order to create drops from a liquid stream, continuous inkjet systems include drop generators. A number of different mechanisms can be employed as drop generators. The drop generator influences the liquid stream emitted by a nozzle at a frequency that forces the liquid stream to be broken up into a series of drops at a point in the vicinity of the nozzle plate. Various drops are then separated from the series of drops. For example, some drops are selected for printing (i.e. printing drops) and are directed towards a recording medium while other drops that are not selected for printing (i.e. non-printing drops) are directed towards a disposal or recycling system.

Various methods known in the art are employed to separate printing drops from non-printing drops. One commonly employed practice includes electrostatically charging and electrostatically deflecting selective ones of the drops using a charge electrode positioned along the flight path of the drops. The function of the charge electrode is to selectively charge the drops as they break off from a liquid stream. One or more deflection plates positioned downstream from the charge electrode create an electric field which deflects a charged drop either towards a catcher assembly or towards a recording medium. Other systems that deflect drops using a gas flow are also known. For example, U.S. Pat. No. 4,068,241, issued to Yamada, on Jan. 10, 1978 describes a gas flow drop deflection system.

Conventional techniques for assembling various elements of a printhead include locating or aligning the elements using an assembly fixture, and then using an adhesive such as epoxy or mechanical fasteners to affix them together. Unfortunately, these assembly and alignment techniques have drawbacks. For example, using an adhesive can increase assembly time because it often takes several hours for the adhesive to cure. Using epoxy can be problematic because epoxy can be sensitive to heat and humidity. Using adhesives or epoxies can hinder the desire to have various printhead components be field replaceable components. Additionally, dedicated assembly fixtures employed for alignment purposes in the factory can also be a detriment when field repairs are necessary.

In some cases, locating elements are provided in various ones of the printhead elements to help provide the necessary alignment during assembly. These locating elements can provide self-aligning capabilities which are desirable in a field replaceable unit. Nonetheless, the locating elements must be formed in a manner that provides the high alignment accuracy required between the mated elements of the printhead such as, for example, the assembly of a jetting module and drop deflection device. Several conventional methods have been employed to form these high precision alignment elements. For example, elements such as precision ground balls or cylindrical pins have been used as locating elements. In many cases these elements must be located relative to one another with high multi-dimensional tolerance requirements. Typically, precision blind bores are machined in at least one of the mated printhead elements to receive the locating elements. A locating element and its corresponding precision blind bore are typically sized to allow for an interference fit between the two. An interference fit is generally provided by sizing two mating components so that one of the components slightly interferes with the space that the other component occupies. When the two components are mated, elastic deformations are generated in each of the components which generate frictional forces that secure the two components together.

Conventional techniques for positioning locating elements have drawbacks. For example, FIG. 6 shows a conventional positioning of a plurality of spherical locating elements 122 which have been pressed into a corresponding plurality of precision blind bores 125 formed in a substrate 130. In many applications, precision alignment between the locating elements 122 is required in three-dimensional space. Such precision alignment in turn requires precision tolerances between the formed blind bores 125 both in a plane of a surface 135 of substrate 130 (i.e. a "planar positioning tolerance") and in a direction normal to surface 135 (i.e. a "normal positioning tolerance"). In particular, the normal positioning tolerances requires precision in both the position and form of the blind surfaces 127 of each of the bores 125. In some cases, when relatively deep bores are required (i.e. for example to locate spherical or pin-like locating elements 122), the bores may wander from their required orientation, thereby creating additional lateral positioning errors L, such as those produced by blind hole 125*a*. Additionally, there are difficulties associated with precisely machining the depth and the flatness of the bottom of the hole leading to vertical position errors V, as illustrated by the blind hole 125*b*. Accordingly, controlling both the depths of the blind bores 125 and the bore-to-bore positioning with the required tolerances increases the manufacturing complexities and costs. These costs typically escalate as the number of bores 125 increases.

As such, there is an ongoing need for improved techniques for positioning locating elements used to align components relative to one another. There is also an ongoing need for improved locating elements in a printhead suitable for providing high precision alignment between various components of the printhead.

SUMMARY OF THE INVENTION

According to an aspect of the present invention, an alignment component includes a first member, a second member, and a plurality of locating elements. The first member includes at least one surface. The second member includes a plurality of through holes that include a first through hole and a second through hole positioned relative to each other. The second member is affixed with the first member such that a first pocket and a second pocket are formed, each of the first pocket and the second pocket having a wall corresponding to a wall of one of the first through hole and the second through hole. Each of the first pocket and the second pocket have a base corresponding to a surface of the one or more surfaces of the first member. The plurality of locating elements include a first locating element positioned with an interference fit in the first pocket and a second locating element positioned with an interference fit in the second pocket. The wall of the first pocket and the wall of the second pocket define a first component of position of the first locating element relative to the second locating element. The base of the first pocket and the base of the second pocket define a second component of position of the first locating element relative to the second locating element.

BRIEF DESCRIPTION OF THE DRAWINGS

In the detailed description of the example embodiments of the invention presented below, reference is made to the accompanying drawings, in which:

FIG. 2A is an exploded isometric view of a printhead frame employed in an example embodiment of the invention;

DETAILED DESCRIPTION OF THE INVENTION

Figure 1:
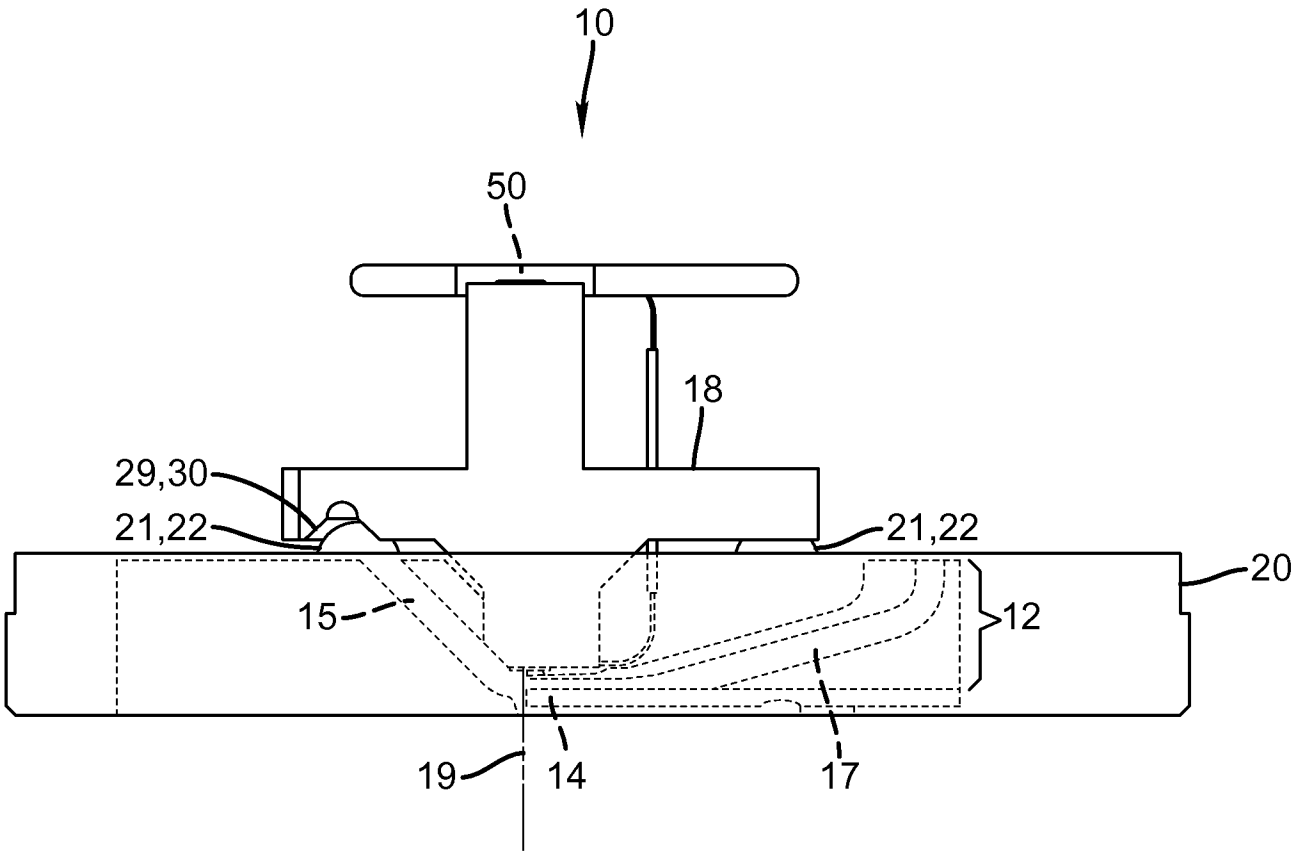
FIG. 1 is a schematic side view of a printhead as per an example embodiment of the invention, the printhead including a jetting module, a drop deflection mechanism and catcher in a printhead frame.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

Referring to FIG. 1, a printhead 10 according to the present invention includes a jetting module 18, a drop deflection mechanism 12, a catcher 14, and a printhead frame 20. The drop deflection mechanism can be a gas flow deflection mechanism, such as described in U.S. Pat. No. 6,588,888, issued to Jeanmaire et al., on Jul. 8, 2003; an electrostatic deflection mechanism, such as described in U.S. Pat. No. 4,636,808, issued to Herron, on Jan. 13, 1987; or other drop deflection mechanisms known in the art. In the embodiment shown in FIG. 1, drop deflection mechanism 12 is a gas flow deflection mechanism, including a positive gas flow duct 15 and a negative gas flow duct 17. Positive gas flow duct 15 is connected to a fan or blower that produces a positive pressure in the positive gas flow duct 15 from which a flow of gas is directed across the trajectories of the drops 19 formed by the jetting module 18. Negative gas flow duct 17 is connected to a vacuum source, producing a vacuum or negative pressure in the negative gas flow duct 17. The suction of gas into negative gas flow duct 17 produces a flow of gas across the drop trajectories 19. Typically, the placement of the blower, vacuum source, and the gas flow extensions that connect the positive and negative gas flow ducts to the blower and vacuum source relative to the jetting module 18 is controlled by the amount of available space around printhead 10. Catcher 14 is shown positioned under the negative gas flow duct 17, but can alternatively be located under the positive gas flow duct 15.

Operation of the printhead 10 depends critically on the alignment of catcher 14 and drop deflection mechanism 12 relative to jetting module 18. In this example embodiment, printhead frame 12 includes a set 21 of locating elements 22. In this example embodiment, the catcher 14 and a portion of the drop deflection mechanism 12 are assembled together, and this catcher-drop deflector assembly is affixed to printhead frame 20. The jetting module 18 includes a set 29 of locating elements 30 (only one is shown in FIG. 1) that correspond to the set 21 of locating elements 22 located in printhead frame 20. In this example embodiment, various ones of the locating elements 30 are integrally formed in jetting module 18. In other example embodiments, various ones of the locating elements 30 can be separate elements that are assembled into jetting module 18. Jetting module 18 also includes a set of fluid and electrical connectors 50.

Figure 2B:
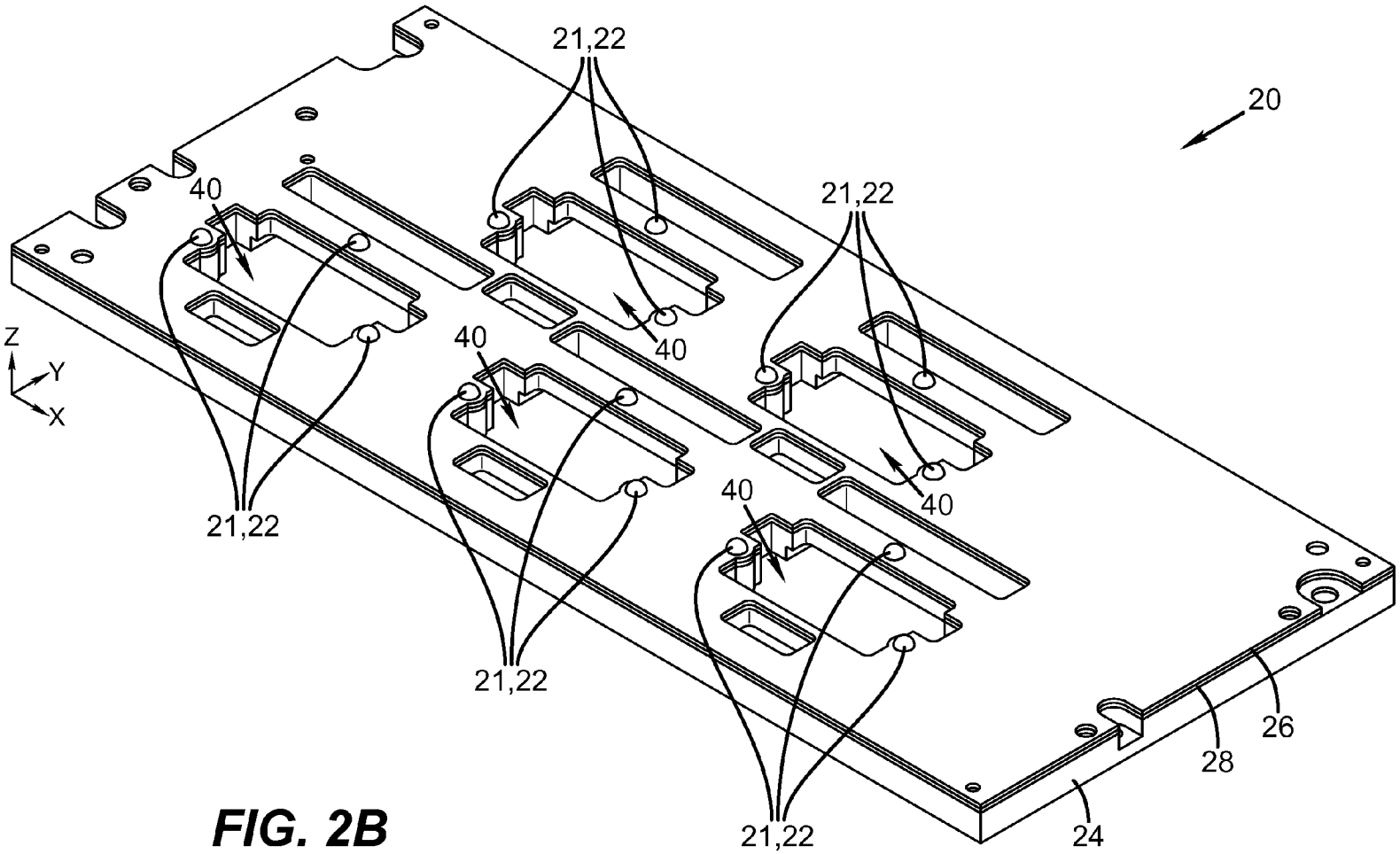
FIG. 2B is an isometric view of the printhead frame of FIG. 2A in an assembled configuration.

FIGS. 2A and 2B respectively show an exploded and assembled view of an alignment component that serves as a printhead frame 20 employed in an example embodiment of the invention. An X-Y-Z coordinate frame is provided in both FIGS. 2A and 2B to aid in the description of the various elements of printhead frame 20. Printhead frame 20 includes a first member 24, a second member 26, a third member 28 and a plurality of locating elements 22. Each of the first member 24, the second member 26 and the third member 28 are planar members and first member 24 is a base plate in printhead frame 20. First member 24 includes a surface 25 adapted to position each of the locating elements 22 relative to one another in a direction normal to the surface 25 (i.e. along a direction of the Z axis in this example embodiment). Surface 25 is a flat surface.

Figure 4:
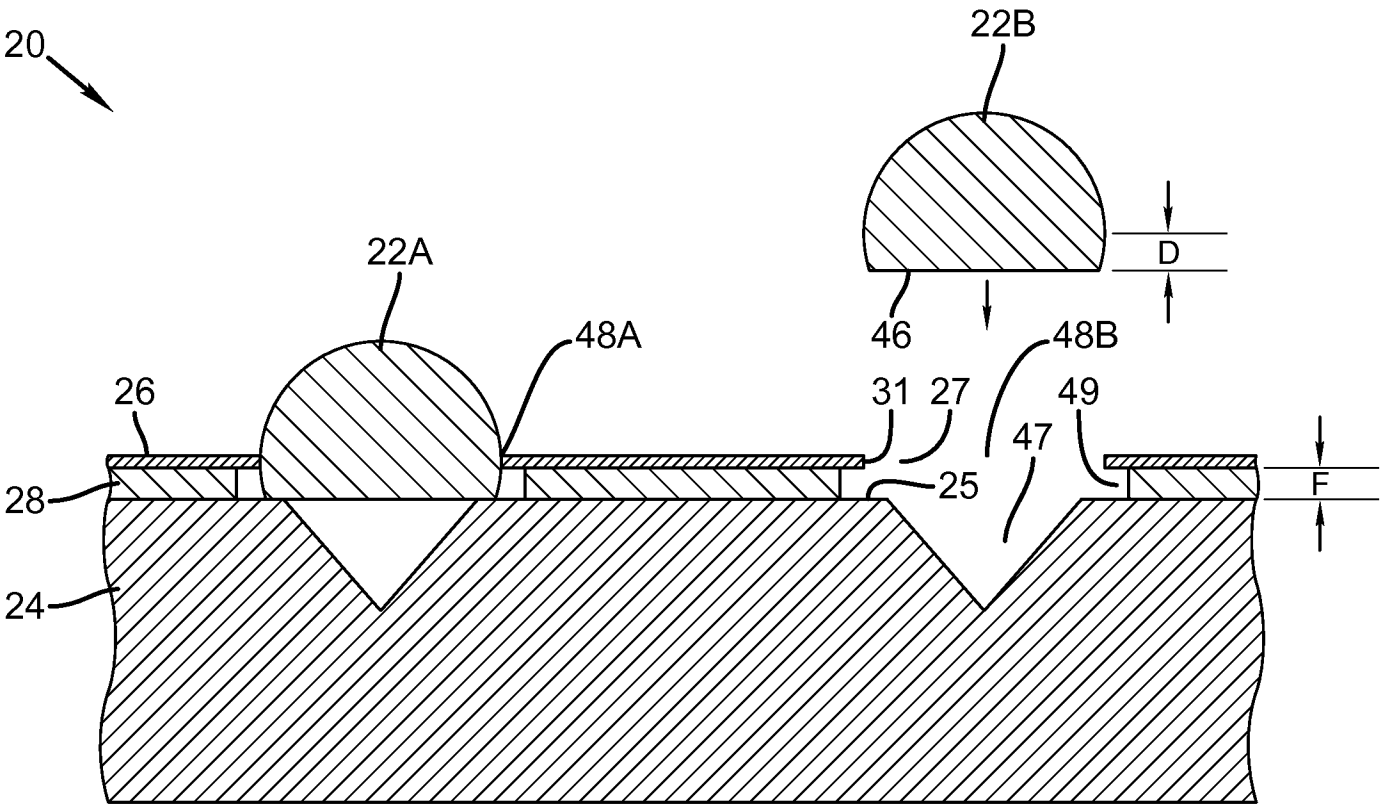
FIG. 4 is a cross sectional view of a first locating element and a second locating element positioned in a portion of printhead frame as per an example embodiment of the invention.

Second member 26 is a locator plate adapted to position each of the locating elements 22 relative to one another in a plane of a surface of the locator plate (i.e. a plane defined by the X-Y plane in this example embodiment). The second member 26 includes a plurality through holes 27, each of the through holes 27 including a wall 31 adapted to locate one of the locating elements 22 relative to another of the locating elements 22. Third member 28 is positioned between first member 24 and second member 26. The third member 28 has a pattern of through holes 49 that correspond to the pattern of through holes 27 in the second member. In this example embodiment, third member 28 acts as a spacer member between first member 24 and second member 26. The diameter of the through holes 49 in the third member 28 is larger than the diameter of the through holes 27 in the second member to ensure clearance between the locating elements 22 and the walls of the through holes 49 as shown in FIG. 4. First member 24 can be affixed to second member 26 in various manners. For example, third member 28 can include an adhesive adapted to bond first member 24 with second member 26. In other embodiments, third member 28 includes a film adhesive.

Referring to FIG. 2B, printhead frame 20 includes a plurality of ports 40. Each of the ports 40 correspond to a desired placement location of one of a plurality of jetting modules 18 (not shown) allowing them to print on the print media together to enhance printing throughput. In this example embodiment, five (5) ports 40 are shown in a staggered formation. The staggered formation is employed to enable the print swaths from each of the plurality of jetting modules 18 to be stitched together when each of the jetting modules 18 has a physical size which does not allow for a linear stitching arrangement. In this example embodiment, a catcher 14/drop deflection mechanism 12 assembly (shown in FIG. 1) are associated with each of the ports 40. However, printhead frame 20 can incorporate other suitable numbers and arrangements of jetting modules 18, drop deflection mechanisms 12 and catchers 14.

In this example embodiment, the plurality of locating elements 22 are arranged in various sets 21, each set 21 corresponding to one of the ports 40 and each set 21 includes three (3) of the locating elements 22 as shown in FIG. 2B. To ensure that the images printed by the drops from each of the jetting modules do stitch together as intended, it is necessary for each of the sets 21 of locating elements 22 to be precisely aligned to each of the other sets 21 of locating members 22. The alignment of the various sets 21 to each others must be ensured not only laterally, in the X-Y plane, but also in the Z axis direction. Furthermore, the alignment planes defined by each set 21 of locating elements 22 should be parallel to each other. As some embodiments of the printing system print documents over 0.5 meters wide, the alignment precision of the three locating member sets 21 to each other should be held over similar distances.

Figure 3:
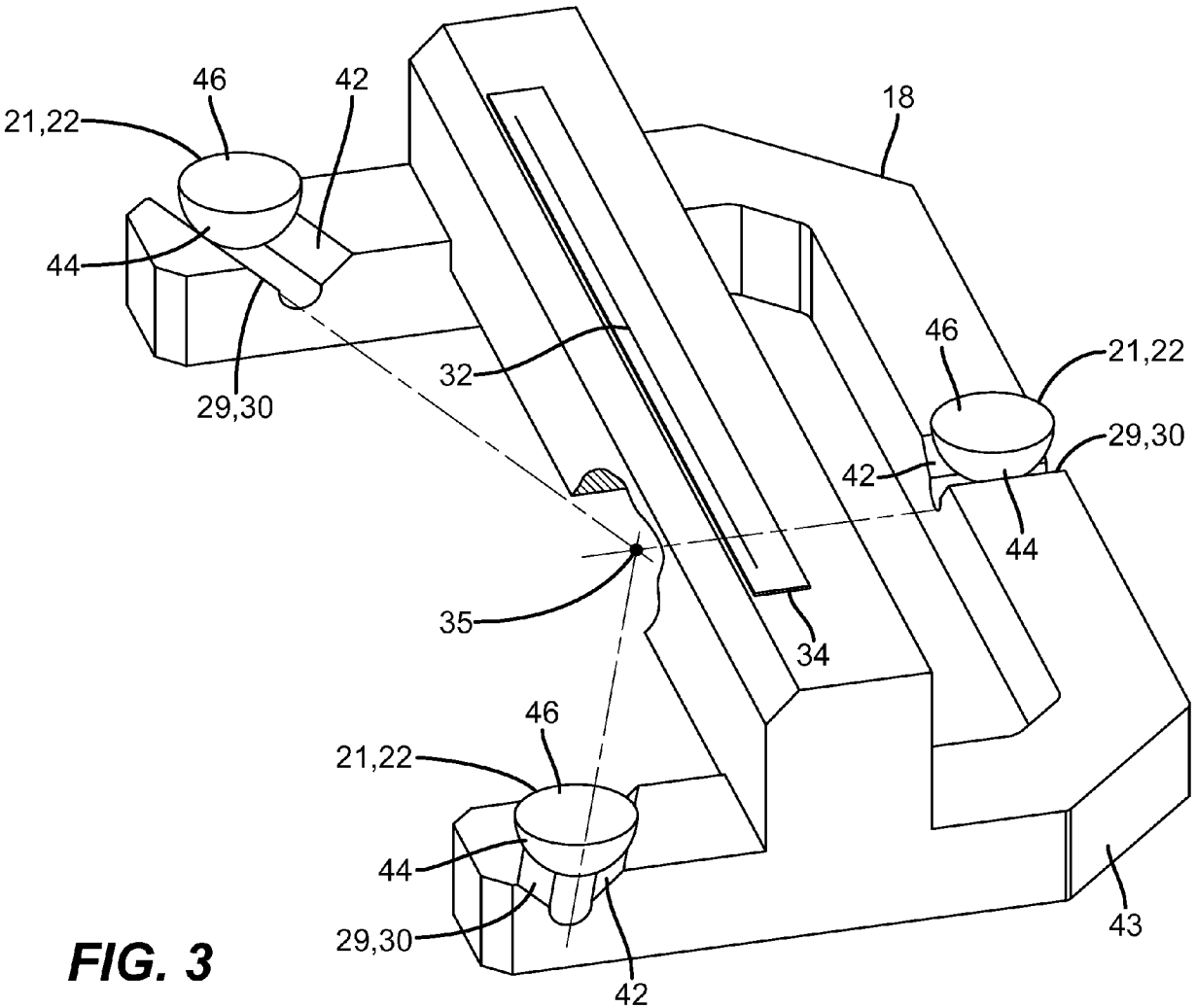
FIG. 3 is an inverted isometric view of a jetting module, a first set of locating elements and a second set of locating elements as per an example embodiment of the invention.

Locating elements 22 are preferably kinematic alignment elements. Kinematic alignment elements allow a jetting module 18 to be precisely positioned in relation to printhead frame 20. One type of kinematic mount, known as a "2-2-2 mount" or a "three grove mount" is shown in FIG. 3. In FIG. 3, jetting module 18 is in an inverted position to show a set 29 of three (3) locating elements 30. Each of the locating elements 30 includes a V-groove 42 that are provided in a coupling member 43 of jetting module 18. Each of the V-grooved locating elements 30 includes a plurality of surfaces adapted to form contact with a respective one of the locating elements 22. As shown, each of the V-grooved locating elements 30 extends along a direction that intersects a substantially common point 35. The corresponding set 21 of locating elements 22 is positioned such that a locating element 22 is in contact with each respective one of the V-grooved locating elements 30. In this example embodiment, each of the locating elements 22 comprises a hemispherical surface 44 and a flat surface 46. Each of the locating elements 22 is positioned such that its hemispherical surface 46 contacts a respective one of the V-grooved locating elements 30. When the spacing of the three locating elements 22 is fixed by some structure (which has been hidden in FIG. 3 to better show the engagement of the various elements), the three V-grooved locating elements 30 can engage the three locating elements 22 (i.e. each V-groove 42 contacting a hemispherical surface 44 at two points) in only one position constraining all six degree of freedom of the coupling member 43. When jetting module 18 is separated from the locating elements 22, the jetting module can be returned to the original position with high placement precision by again having the locating elements 30 engage the locating elements 22.

While the 2-2-2 mount is used in the example embodiment shown in FIG. 3, other kinematic mount configurations, such as a "3-2-1 mount," can be employed in other example embodiments of the invention. In a 3-2-1 mount, also known as a "cone, groove and flat" mount, one part of the kinematic mount would include the three hemi-spherically shaped locating elements 22 and a second part of the kinematic mount would include a cone-shaped locating element 30 which constrains three (3) degrees of freedom, a V-groove shaped locating element 30 that constrains two (2) degrees of freedom, and a flat shaped locating element 30 that constrains one degree of freedom. In this way, all six degrees of freedom can be defined.

The use of kinematic mount elements can provide reproducible alignment of printhead elements, such as the alignment of jetting module 18 to printhead frame 20. Kinematic mount elements can be used to enable interchangeability of parts which can greatly enhance field replacement efforts. Also, the use of a kinematic mount to provide reproducible alignment between two elements such as jetting module 18 and printhead frame 20 can be used to establish required alignments with other printhead elements. For example, in the printhead production process, fixtures that engage the locating elements 30 of the jetting module 18 can be used to align a nozzle array 32 of a nozzle plate 34 (shown in FIG. 3) with high precision to the locating elements 30 of jetting module 18. Similarly, fixtures that engage the locating elements 22 of the printhead frame 20 can be used to align the catcher 14/drop deflector mechanism 12 assembly of printhead 10 with high precision relative to the locating elements 22. In this manner, the nozzle array 32 of the nozzle plate 34 attached to the jetting module 18, the catcher 14, and the drop deflector mechanism 12 assembly are precisely aligned relative to respective kinematic elements. Engagement of the kinematic elements of the jetting module 18 with the kinematic elements of the printhead frame 20 produces consistent alignment of the nozzle array 32 to the gas flow ducts 15, 17 and catcher 14. It is noted that although the described embodiment indicates that the set 21 of locating elements 22 is positioned on printhead frame 20 while the corresponding set 29 of locating elements 30 is positioned on jetting module 18, the reverse can be employed in other embodiments of the invention.

The consistency of alignment of the critical printhead elements, for example, nozzle array 32, drop deflection mechanism 12, and catcher 14, depend on the consistency of the locating elements 22, 30. The locating elements 22 are preferably fabricated from a material, for example, a ceramic or metallic material, that won't significantly deform under the influence of the contact forces that are generated during the engagement. In some example embodiments, metallic locating elements 22 are additionally hardened or toughened to improve characteristics such as yield strength and wear resistance. When locating elements 22 are hemispherical, the hemispherical locating elements 22A, 22B can be formed by securing a plurality of spherical members (i.e. precision bearing balls) in a fixture and grinding the members into the desired pseudo-hemispherical shapes as shown in FIG. 4.

The locating elements 22 shown in FIG. 4 have a flat face 46 that is spaced away from the center of the sphere by a distance D. Very tightly toleranced hemispherical locating elements 22 can be formed in this manner. It can be beneficial to harden the contact surfaces of the V-groove locating elements 30 that are fabricated into jetting module 18 in some example embodiments of the invention. Alternatively, the contact surfaces of the V-grooves 42 can be provided by inserts of a material, such as hardened metal or ceramic, that won't significantly deform under the influence of the contact stresses generated during the engagement.

FIG. 4 shows a cross sectional view of portion of the printhead frame 20, having a first and second pockets 48*a* and 48*b* for holding and defining the locations of first and second location elements 22A and 22B. In FIG. 4, first locating element 22A positioned within the first pocket 48*a*, while the second locating element 22B is positioned above the second pocket 48*b* to enable the features of the pocket and the locating element to be more readily seen.

In this example embodiment, the printhead frame is formed as an assembly of a first member 24, a second member 26 and a third member 28. As each pocket in the printhead frame is of similar construction, the figure only shows reference numbers for a single pocket. Second member 26 includes a first through hole 27 and second through hole that are positioned relative to each other with a desired x-y spatial relationship for the first and second pockets. Third member 28 includes a set of through holes 49 that are spatially arranged on the member in the same arrangement as the through holes 27 in the second member 26. Second member 26 has been affixed with along with the third member 28 to the first member 24 such that a first pocket 48A and a second pocket 48B are formed in printhead frame 20. Each of the first pocket 48A and the second pocket 48B includes a surface defined by a wall 31 of a corresponding one of the first and second through holes 27. Each of the first pocket 48A and the second pocket 48B has a base corresponding to surface 25 of first member 24.

In this example embodiment, each of the locating elements 22A, 22B are positioned with an interference fit in a respective one of the pockets 48A and 48B. Each of the locating elements 22 includes a surface adapted for contact with a base of the corresponding pocket 48. Specifically, the flat surface 46 of each of the locating elements 22 is made to contact a base of a corresponding pocket 48.

Unlike conventional methods where a plurality of locating elements are positioned in relatively expensively machined holes having both precision hole-to-hole x-y tolerances as well as precision bore depth tolerances, the example embodiments of the present invention reduce the costs associated with the required alignment of the locating elements 22A and 22B.

Since an interference fit is employed in this example embodiment, the wall 31 of the first pocket 48A and the wall 31 of the second pocket 48B define a first component of position of the first locating element 22A relative to the second locating element 22B. In this example embodiment, the first component of position is the x-y position, that is, the position within the plane of the surface 25 of first member 24. The first component of position is a planar position relative to a surface of second member 26.

In this example embodiment, second member 26 is a relatively thin planar member as compared to first member 24. The "thin" form of second member 26 allows through holes 27A and 27B to be formed with reduced bore directional errors that can be associated with the machining of deeper bind holes. In some example embodiments, chemical machining techniques are employed to form a plurality of through holes 27 in a thin second member 26. Chemical machining is well suited for forming through holes in thin substrates, the formed holes having tight dimensional size tolerances as well as tight hole-to-hole positional tolerances.

In other example embodiments, a ganged machining process can be used to form the through holes 27 in a stack of thin second members 26. The ganged machining process can involve performing a rough cut with a laser or other process followed by a jig grinding process to achieve the precision required. Ganged machining techniques can be used to simultaneously form identical features in each of a plurality of second members 26. This provides more consistency between each of the second members 26 than would be achieved if each second member 26 was individually machined. This can be especially advantageous when the plurality of second members 26 is employed in the jetting modules 18 of a multicolor printer because the identical nature of each of the second members 26 can reduce color-to-color misalignments. It is to be understood that other thicknesses of the members can be employed. The choice of the thicknesses for the first, second, and third members should be consistent with the anticipated loading forces applied to the locating members and span of the printhead frame 20 for the application. In one example embodiment, the first member 24 has a thickness of 25 mm, the second member 26 a thickness of 1 mm, and the third member 28 a thickness of 2.5 mm.

Bases 25 of each of the first pocket 48A and the second pocket 48B define a second component of position of the first locating element 22A relative to the second locating element 22B. In this example embodiment, the second component of position is the normal or orthogonal position relative to surface 25 of first member 24. In other example embodiments, the second component of position is a normal or orthogonal position relative to a surface of second member 26.

Since each base is defined by the surface 25 of first member 24, this positioning is hence defined by a flatness tolerance of surface 25. Precision surface machining techniques (e.g. surface grinding or surface lapping techniques) can be employed to impart a desired flatness to surface 25. In this regard, the present inventors have determined that imparting a precision flat surface 25 on first member 24 produces a more accurate result and is more economical than forming a plurality of bores, each bore being machined with a precision depth tolerance. In some example embodiments, pluralities of surfaces of first member 24 are employed to define the bases of the pockets 48A and 48B. For example, the first member 24 may be initially cast or molded with a plurality of raised pads. Machining each of the pads to the desired flatness specification can be especially economical since less material needs to be removed. First member 24 can be manufactured from various materials including metals such as steel or stainless steel. It is noted that contact stresses are considerably reduced when the locating elements 22A and 22B are positioned within their corresponding pockets 48A and 48B since relatively large area contact is provided by the mated flat surfaces 46 and flat surface 25.

In other example embodiments, opposing surfaces of first member 24 are machined and a first second member 26 is attached to a first surface of the first member and a second second member 26 is attached to a second surface of the first member 24. Although the second surface of first member 24 is usually opposite that of the first surface of first member 24, other relative configurations of the second surface of first member 24 and the first surface of first member 24 are permitted. Locating elements can then be inserted onto pockets on the first and second sides of the first member for the precise alignment of printer components to both faces of the alignment component.

In the embodiment shown in FIG. 4, a plurality of reliefs 47 have been formed in first member 24 with each relief 47 being formed in the vicinity of the one of the pockets 48A and 48B. As a result of the relief, the contact surface between the locating elements 22A and 22B is in the form of a ring. This reduces the risk that dirt in the contact area or non-flat machining of either the surface 25 or the flat face 46 of the locating elements 22A and 22B could allow the locating elements to rock on the surface 25. The diameter of the relief is chosen such that the contact surface has sufficient area to handle the forces applied to the locating elements 22 without producing inelastic deformation to either the locating elements 22 or the first member 24.

Reliefs 47 can be formed in various manners. In some example embodiments, reliefs 47 are formed with a machine tool such as a drill or chamfering tool. In other example embodiments, the relief is formed by machining a hole through the base plate. The through hole may optionally include a chamfer. As the machining of the relief by any of these methods may create a burr, typically, surface 25 is machined to the required flatness tolerances after the formation of reliefs 47.

Each of first locating element 22A and second locating element 22B can be positioned within their corresponding pockets 48A and 48B in a variety of ways. For example, the locating element can simply be pressed into a corresponding pocket for certain levels of an interference fit. In other example embodiments, the size of one or both of a locating element 22 and its corresponding pocket is changed by heating or cooling. The heating or cooling is conducted to temporarily alter the size of one or both of the locating element 22 and its corresponding pocket 48 to remove the interference between the two. Once these components are assembled together, the heated or cooled component(s) are restored to their ambient conditions to re-establish the interference fit which rigidly couples the locating element in the corresponding pocket. In some example embodiments, the present inventors have employed stainless steel pseudo-hemispherical locating elements 22 which were cooled in liquid nitrogen prior to being positioned into corresponding pockets 48. Interference fits of five (5) to twenty (20) microns have been used to position the locating elements within their corresponding pockets.

As shown in FIG. 4, second member 26 is spaced apart from first member 24 by third member 28. Third member 28 comprises a plurality of through openings 49 positioned in a corresponding manner with the through holes 27A and 27B formed in second member 26. In this example embodiment, each of the through openings 49 are sized and positioned to allow for clearance between the through opening 49 and a corresponding one of the first locating member 22A and second locating member 22B. To ensure that the walls 31 of the through holes 27 contact the locating members 22 at the great circle of the spheres, the flat faces of the locating members 22 are offset from the center of the spheres by an amount D that is approximately equal to the thickness of the third member plus one half the thickness of the second layer, distance F. As used herein, the term "great circle" is defined as the circle produced by a plane passing through the center of a sphere. Third member 28 can have additional or alternate functions including acting as an adhesive layer that affixes first member 24 to second member 26.

Figure 5:
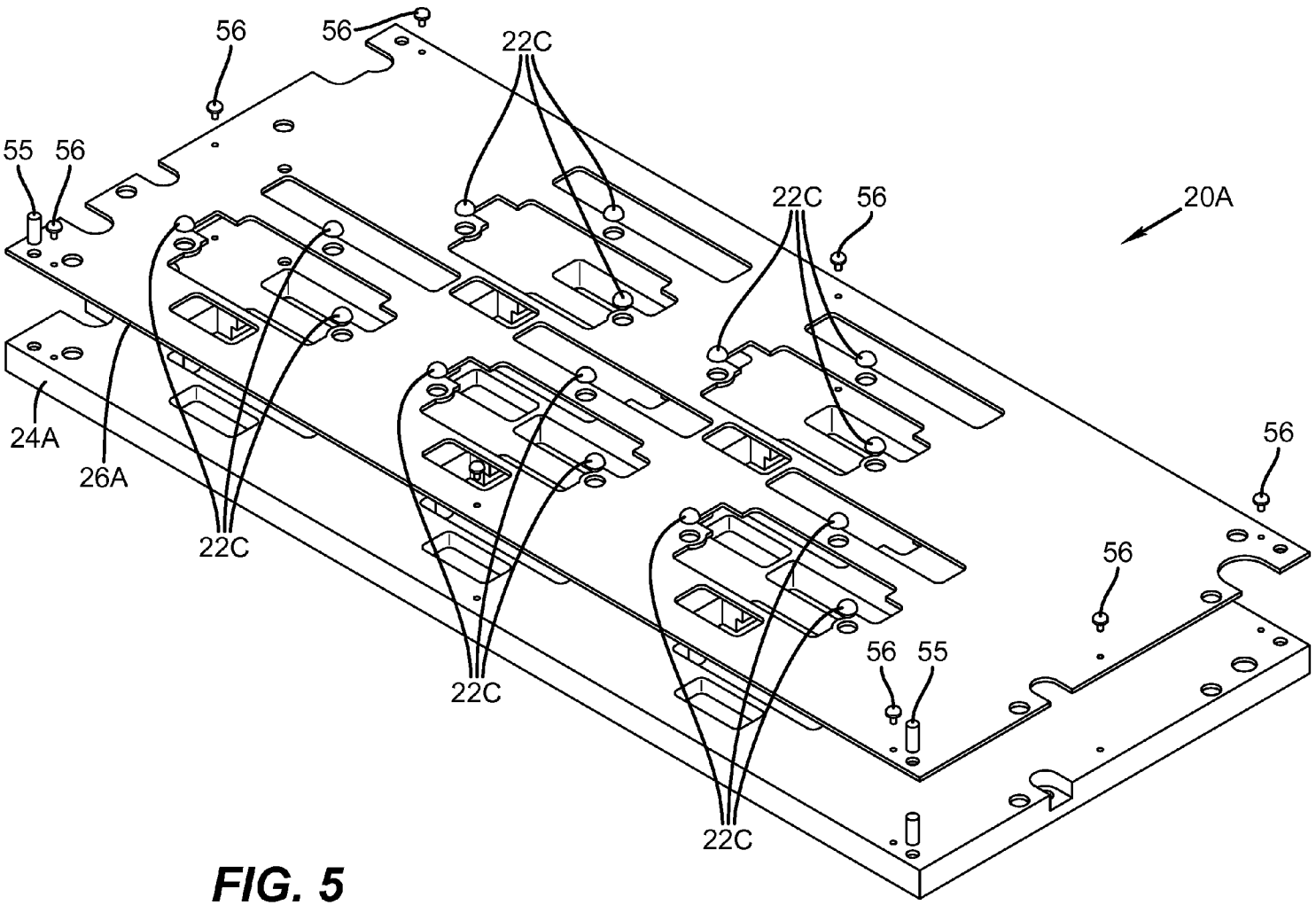
FIG. 5 is a printhead frame employed in another example embodiment of the invention.
Figure 6:
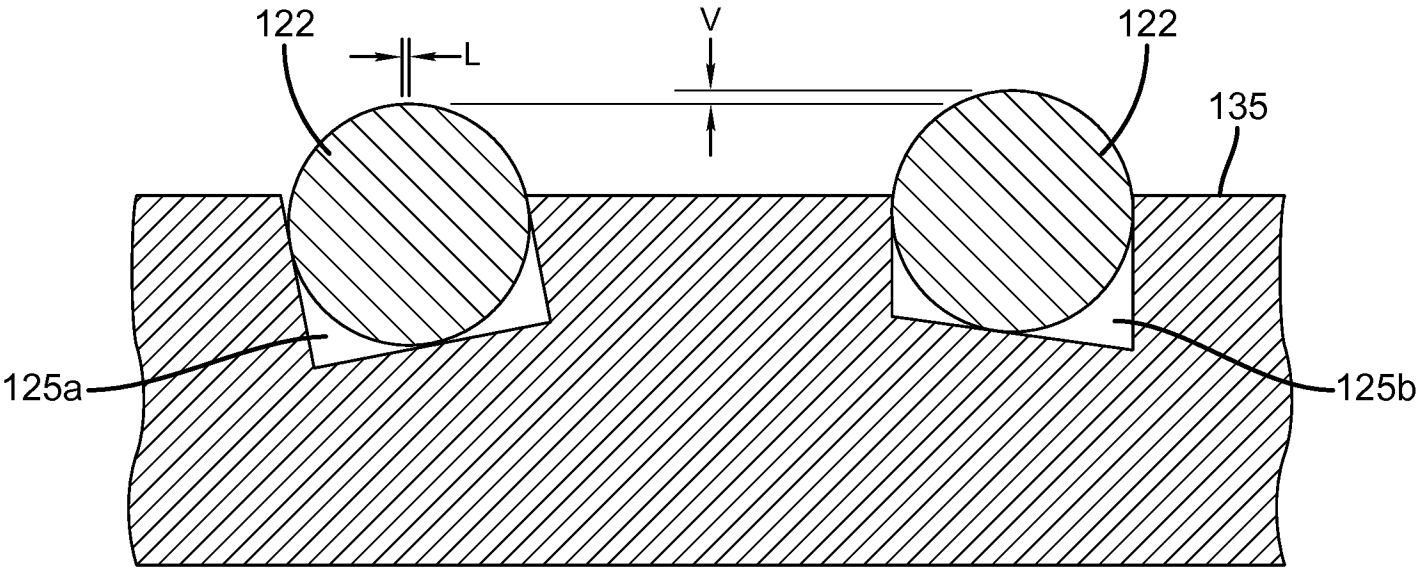
FIG. 6 PRIOR ART
FIG. 6 shows a conventional positioning of a plurality of locating elements which have been pressed into a corresponding plurality of blind bores.

In other example embodiments, mechanical fasteners are employed. For example, referring to FIG. 5, an exploded view of a printhead frame 20A formed from a first member 24A and a second member 26A and plurality of locating elements 22C is shown. A plurality of precision dowel pins 55 and a plurality of screw fasteners 56 are employed to align and affix second member 26A with first member 24A. In this example embodiment, a third member is not positioned between first member 24A and second member 26A.

Although various example embodiments of the present invention have described the use of approximately hemispherically shaped locating elements 22, other example embodiments can employ locating elements 22 having other shapes. For example, cylindrically shaped locating elements 22 can be used in some applications.

Although the example embodiments of the present invention have been described in conjunction with the use of continuous inkjet systems, the present invention is not limited to continuous inkjet printing systems. For example, while the illustrated embodiments of the alignment component have formed the printhead frame for a multiple jetting module line head, the alignment component of the present invention can be employed as a printhead frame for a single jetting module printhead. Additionally, embodiments of the present invention can be employed to align various components in a drop-on-demand (DOD) printing systems. Without limitation, the present invention can be used to provide precision alignment of kinematic mount components employed in variety of different applications.

The invention has been described in detail with particular reference to certain example embodiments thereof, but it will be understood that variations and modifications can be effected within the scope of the invention.

PARTS LIST

10 printhead
12 drop deflection mechanism
14 catcher
15 positive gas flow duct
17 negative gas flow duct
18 jetting module
19 drop trajectories
20 printhead frame
20A printhead frame
21 set
22 locating elements
22A first locating element
22B second locating element
22C locating elements
23 set
24 first member
24A first member
25 surface
26 second member
26A second member
27 through hole
27A first through hole
27B second through hole
28 third member
29 set
30 locating elements
31 wall
32 nozzle array
34 nozzle plate
35 common point
40 port
42 V-groove
43 coupling member

44 hemispherical surface
45 through openings
46 flat surface
47 reliefs
48A first pocket
48B second pocket
49 though openings
50 fluid and electrical connectors
55 dowel pins
56 screw fasteners
122 locating elements
125 blind bores
127 blind surface
130 substrate
135 surface
137 blind surface
Δ deviation
X axis
Y axis
Z axis
D amount
F distance

The invention claimed is:

1. An alignment component comprising:

a first member including at least one surface;

a second member including a plurality of through holes, the plurality of through holes of the second member including a first through hole and a second through hole positioned relative to each other, the second member being affixed with the first member such that a first pocket and a second pocket are formed, each of the first pocket and the second pocket having a wall corresponding to a wall of one of the first through hole and the second through hole, and each of the first pocket and the second pocket having a base corresponding to a surface of the one or more surfaces of the first member; and a plurality of locating elements including a first locating element positioned with an interference fit in the first pocket and a second locating element positioned with an interference fit in the second pocket, the wall of the first pocket and the wall of the second pocket defining a first component of position of the first locating element relative to the second locating element, and the base of the first pocket and the base of the second pocket defining a second component of position of the first locating element relative to the second locating element.

2. The alignment component of claim 1, the first component of position being a planar position relative to a surface of the second member and the second component of position being a normal position relative to the surface of the second member.

3. The alignment component of claim 1, the first component of position being a planar position relative to a surface of the second member and the second component of position being a normal position relative to the one or more surfaces of the first member.

4. The alignment component of claim 3, including a third member positioned between the first plate and the second plate.

5. The alignment component of claim 4, the third member including an adhesive adapted for adhering to at least one of the first member and the second member.

6. The alignment component of claim 4, the third member including a plurality of through openings, each through opening of the plurality of through openings of the third member being sized to allow for clearance between the through opening and a respective one of the locating elements.

7. The alignment component of claim 3, including an adhesive adapted for affixing the second member with the first member.

8. The alignment component of claim 3, including one or more fasteners adapted for affixing the second member with the first member.

9. The alignment component of claim 3, wherein at least one of the first locating element and the second locating element includes a hemispherical surface.

10. The alignment component of claim 9, wherein the hemispherical surface of each of the at least one of the first locating element and the second locating element provides the interference fit when each of the at least one of the first locating element and the second locating element is positioned in a corresponding one of the first pocket and the second pocket.

11. The alignment component of claim 9, each of the at least one of the first locating element and the second locating element including a surface adapted for contact with the base of the corresponding one of the first pocket and the second pocket.

12. The alignment component of claim 9, each of the one or more surfaces of the first member being flat and each of the at least one of the first locating element and the second locating element including a flat surface adapted for contact with the base of the corresponding one of the first pocket and the second pocket.

13. The alignment component of claim 9, wherein the alignment component is a first alignment component of an assembly, and the hemispherical surface of each of the at least one of the first locating element and the second locating element is adapted for locating a second alignment component of the assembly relative to the first alignment component.

14. The alignment component of claim 3, wherein the alignment component is a first alignment component of an assembly and the plurality of locating elements form part of a kinematic mount adapted to locate a second alignment component of the assembly relative to the first alignment component.

15. The alignment component of claim 14, the kinematic mount being a 2-2-2 mount.

16. The alignment component of claim 14, the kinematic mount being a 3-2-1 mount.

17. The alignment component of claim 1, wherein the first member is planar.

18. The alignment component of claim 1, wherein the second member is planar.

19. The alignment component of claim 4, wherein the third member is planar.

* * * * *